US011644245B2

(12) United States Patent
Beaver et al.

(10) Patent No.: US 11,644,245 B2
(45) Date of Patent: May 9, 2023

(54) INDIRECT HEAT EXCHANGER HAVING CIRCUIT TUBES WITH VARYING DIMENSIONS

(71) Applicant: Baltimore Aircoil Company, Inc., Jessup, MD (US)

(72) Inventors: Andrew Beaver, Colorado Springs, CO (US); David Andrew Aaron, Reisterstown, MD (US); Yohann Lilian Rousselet, Boston, MA (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 1 day.

(21) Appl. No.: 16/858,275

(22) Filed: Apr. 24, 2020

(65) Prior Publication Data

US 2020/0256621 A1 Aug. 13, 2020

Related U.S. Application Data

(63) Continuation of application No. 15/291,773, filed on Oct. 12, 2016, now Pat. No. 10,655,918.

(51) Int. Cl.
*F28D 7/00* (2006.01)
*F28D 1/047* (2006.01)
(Continued)

(52) U.S. Cl.
CPC ..... *F28D 7/0066* (2013.01); *F28D 1/0478* (2013.01); *F28F 1/006* (2013.01);
(Continued)

(58) Field of Classification Search
CPC ..... F28F 2210/08; F28F 1/006; F28F 9/02; F28F 1/025; F28D 7/0066; F28D 1/0478
See application file for complete search history.

(56) References Cited

U.S. PATENT DOCUMENTS 34,648 A 3/1862 Sherman
1,825,321 A 9/1931 Mont
(Continued)

FOREIGN PATENT DOCUMENTS

CN 201621989 U 11/2010
DE 4033636 A1 4/1992
(Continued)

OTHER PUBLICATIONS

Translation of German Patent Document entitled Translation—DE102011113045A1 (Year: 2013).*
(Continued)

*Primary Examiner* — Paul Alvare
(74) *Attorney, Agent, or Firm* — Fitch, Even, Tabin & Flannery LLP

(57) ABSTRACT

An improved indirect heat exchanger including a plurality of coil circuits, with each coil circuit comprised of an indirect heat exchange section tube run or plate. Each tube run or plate has at least one change in its geometric shape or may have a progressive change in its geometric shape proceeding from the inlet to the outlet of the circuit. The change in geometric shape along the circuit length allows simultaneously balancing of the external airflow, internal heat transfer coefficients, internal fluid side pressure drop, cross sectional area and heat transfer surface area to optimize heat transfer.

37 Claims, 11 Drawing Sheets

(51) Int. Cl.
*F28F 1/02* (2006.01)
*F28F 1/00* (2006.01)
*F28F 9/02* (2006.01)

(52) U.S. Cl.
CPC ..... *F28F 1/025* (2013.01); *F28F 9/02* (2013.01); *F28F 2210/08* (2013.01)

(56) References Cited

U.S. PATENT DOCUMENTS

| | | | | |
|---|---|---|---|---|
| 2,181,927 | A | 12/1939 | Townsend | |
| 2,792,200 | A | 5/1957 | Huggins | |
| 2,890,864 | A * | 6/1959 | Stutz | F28D 5/02 62/310 |
| 3,148,516 | A | 9/1964 | Kals | |
| 4,196,157 | A | 4/1980 | Schinner | |
| 4,434,112 | A | 2/1984 | Pollock | |
| 4,586,565 | A | 5/1986 | Hallstrom | |
| 4,657,070 | A | 4/1987 | Kluppel | |
| 4,755,331 | A * | 7/1988 | Merrill | F28D 5/02 261/153 |
| 4,763,725 | A | 8/1988 | Longsworth | |
| 4,785,879 | A | 11/1988 | Longsworth | |
| 4,838,997 | A | 6/1989 | Merk | |
| 5,353,868 | A * | 10/1994 | Abbott | F28F 1/325 165/171 |
| 5,417,199 | A * | 5/1995 | Jamieson | F24H 3/087 126/110 AA |
| 5,435,382 | A | 7/1995 | Carter | |
| 6,470,878 | B1 | 10/2002 | Brown | |
| 6,484,798 | B1 | 11/2002 | Manohar | |
| 6,766,655 | B1 | 7/2004 | Wu | |
| 6,808,016 | B2 | 10/2004 | Wu | |
| 6,820,685 | B1 | 11/2004 | Carter | |
| 6,916,453 | B2 | 7/2005 | Filippi | |
| 7,096,933 | B1 * | 8/2006 | Zia | F24H 3/105 165/170 |
| 7,143,822 | B2 * | 12/2006 | Wisniewski | F28D 1/0443 165/140 |
| 7,228,711 | B2 | 6/2007 | Taras | |
| 7,296,620 | B2 | 11/2007 | Bugler, III | |
| 7,802,439 | B2 | 9/2010 | Valiya-Naduvath | |
| 8,938,988 | B2 | 1/2015 | Yanik | |
| 9,004,464 | B2 | 4/2015 | Hazama | |
| 9,057,563 | B2 | 6/2015 | Carter | |
| 9,057,564 | B2 | 6/2015 | Carter | |
| 9,279,619 | B2 | 3/2016 | Aaron | |
| 10,571,197 | B2 | 2/2020 | Beaver | |
| 10,641,554 | B2 | 5/2020 | Beaver | |
| 10,655,918 | B2 | 5/2020 | Beaver | |
| 2004/0071606 | A1 | 4/2004 | Filippi | |
| 2004/0200602 | A1 | 10/2004 | Hugill | |
| 2010/0089560 | A1 | 4/2010 | Shikazono | |
| 2010/0139902 | A1 | 6/2010 | Baylis | |
| 2011/0056668 | A1 | 3/2011 | Taras | |
| 2011/0100593 | A1 | 5/2011 | Benz | |
| 2014/0096555 | A1 | 4/2014 | Ayub | |
| 2014/0166254 | A1 | 6/2014 | Carter | |
| 2014/0264974 | A1 | 9/2014 | Aaron | |
| 2015/0308295 | A1 | 10/2015 | Gaiser | |
| 2016/0290688 | A1 | 10/2016 | Kusuda | |
| 2018/0100700 | A1 | 4/2018 | Beaver | |
| 2018/0100701 | A1 | 4/2018 | Beaver | |

FOREIGN PATENT DOCUMENTS

| | | | | |
|---|---|---|---|---|
| DE | 102011113045 | A1 * | 3/2013 | F28D 9/0037 |
| EP | 0272766 | A1 | 6/1988 | |
| JP | H03117860 | A | 5/1991 | |
| WO | 8400207 | A1 | 1/1984 | |
| WO | 2009111129 | A1 | 9/2009 | |

OTHER PUBLICATIONS

Chinese Office Action with English translation from related Chinese Patent Application No. 201710947015.2 dated Jan. 25, 2019, 17 pages.

Chinese Office Action with English translation from related Chinese Patent Application No. 201710947015.2 dated Jul. 30, 2019, 14 pages.

Deepakkumar et al. "Air side performance of finned-tube heat exchanger with combination of circular and elliptical tubes" Applied Thermal Engineering 119 (2017) 360-372.

Eurasian Office Action with English translation from Eurasian Patent Application No. 201792002 dated Feb. 13, 2019; 3 pages.

European Patent Office, Extended European Search Report dated Mar. 13, 2018, from related European Patent Applicatin No. 17195695. 6, 7 pages.

EVAPCO Brochure, p. 4, 2014.

U.S. Final Office Action from U.S. Appl. No. 15/291,856 dated Oct. 9, 2018; 13 pages.

U.S. Final Office Action from U.S. Appl. No. 15/291,879 dated Feb. 28, 2019; 22 pages.

U.S. Office Action from U.S. Appl. No. 15/291,856 dated Apr. 17, 2018; 19 pages.

U.S. Office Action from U.S. Appl. No. 15/291,856 dated Mar. 15, 2019; 16 pages.

U.S. Office Action from U.S. Appl. No. 15/291,879 dated Jul. 20, 2018; 24 pages.

* cited by examiner

150

100

103

300

INDIRECT HEAT EXCHANGER HAVING CIRCUIT TUBES WITH VARYING DIMENSIONS

CROSS-REFERENCE TO RELATED APPLICATION

This application is a continuation of U.S. patent application Ser. No. 15/291,773, filed Oct. 12, 2016, which issued as U.S. Pat. No. 10,655,918 on May 19, 2020, which is hereby incorporated herein by reference in its entirety.

BACKGROUND AND SUMMARY OF THE INVENTION

The present invention relates to heat exchangers, and more particularly, to an indirect heat exchanger comprised of a plurality of tube run circuits. Each circuit is comprised of a tube having a plurality of tube runs and a plurality of return bends. Each tube may have the same surface area from near its connection to an inlet header to near its connection to an outlet header. However, the geometry of the tube run is changed as the tube runs extend from the inlet to near the outlet header. In one case, the horizontal cross sectional dimension of the tube runs decrease as the tube runs extend to near the outlet header. Such decrease in horizontal cross sectional dimension may be progressive from the near the inlet header to near the outlet header or each coil tube run may have a uniform horizontal cross sectional dimension, with at least one horizontal cross section dimension of tube runs decreasing nearer to the outlet header.

In particular, an indirect heat exchanger is provided comprising a plurality of circuits, with an inlet header connected to an inlet end of each circuit and an outlet header connected to an outlet end of each circuit. Each circuit is comprised of a tube run that extends in a series of runs and return bends from the inlet end of each circuit to the outlet end of each circuit. In the embodiments, the tube runs may have return bends or may be one long straight tube with no return bends such as with a steam condenser coil. Each circuit tube run has a pre-selected horizontal cross sectional dimension near the inlet end of each coil circuit, and each circuit tube run has a decreasing horizontal cross sectional dimension as the circuit tube extends from near the inlet end of each circuit to near the outlet end of each coil circuit.

The embodiments presented start out with a larger tube geometry either in horizontal cross sectional dimension or cross sectional area in the first runs near the inlet header and then have a reduction or flattening (at least once) in the horizontal cross-sectional dimension of tube runs proceeding from the inlet to the outlet and usually in the direction of airflow. A key advantage towards progressive flattening in a condenser is that the internal cross sectional area needs to be the largest where the least dense vapor enters the tube run. This invites gas into the tube run by reducing the internal side pressure drop allowing more vapor to enter the tube runs. The reduction of horizontal tube run cross sectional dimension, or flattening of the tube in the direction of air flow accomplishes several advantages over prior art heat exchangers. First, the reduced projected area reduces the drag coefficient which imposes a lower resistance to air flow thereby allowing more air to flow. In addition to airflow gains, for condensers, as refrigerant is condensed there is less need for interior cross sectional area as one progresses from the beginning (vapor-low density) to the end (liquid-high density) so it is beneficial to reduce the internal cross sectional area as the fluid flows from the inlet to the outlet allowing higher internal fluid velocities and hence higher internal heat transfer coefficients. This is true for condensers and for fluid coolers, especially fluid coolers with lower internal fluid velocities. In one embodiment shown, the tube may start round and the geometric shape is progressively streamlined for each group of two tube runs. The decision of how many tube runs have a more streamlined shape and a reduction in the horizontal cross sectional dimension and how much of a reduction is required is a balance between the amount of airflow improvement desired, the amount of internal heat transfer coefficient desired, difficulty in degree of manufacturing and allowable internal tube side pressure drop.

Typical tube run diameters covering indirect heat exchangers range from ¼" to 2.0" however this is not a limitation of the invention. When tube runs start with a large internal cross sectional area and then are progressively flattened, the circumference of the tube and hence surface area remain essentially unchanged at any of the flattening ratios for a given tube diameter while the internal cross sectional area is progressively reduced and the projected area in the air flow external to the indirect heat exchanger is also reduced. The general shape of the flattened tube may be elliptical, ovaled with one or two axis of symmetry, a flat sided oval or any streamlined shape. A key metric in determining the performance and pressure drop benefits of each pass is the ratio of the long (vertical) side of the oval to the shortest (horizontal) side. A round tube would have a 1:1 ratio. The level of flattening is indicated by increasing ratios of the sides. This invention relates to ratios ranging from 1:1 up to 6:1 to offer optimum performance tradeoffs. The optimum maximum oval ratio for each indirect heat exchanger tube run is dependent on the working fluid inside the coil, the amount of airside performance gain desired, the desired increase in internal fluid velocity and increase of internal heat transfer coefficients, the operating conditions of the coil, the allowable internal tube side pressure drop as well as the manufacturability of the desired geometry of the coil. In an ideal situation, all these parameters will be balanced to satisfy the exact need of the customer to optimize system performance, thereby minimizing energy and water consumption.

The granularity of the flattening progression is an important aspect of this invention. At one extreme is a design where by the amount of flattening is progressively increased through the length of multiple passes or tube runs of each circuit. This could be accomplished through an automated roller system built into the tube manufacturing process. A similar design with less granularity would involve at least one step reduction such that one or more passes or tube runs of each circuit would have the same level of flattening. For example, one design might have the first tube run with no degree of flattening, as would be the case with a round tube, and the next three circuit tube runs would have one level of compression factor (degree of flattening) and the final four tube run passes would have another level (higher degree) of compression factor. The least granular design would have one or more passes or tube runs of round tube followed by one or more passes or tube runs of a single level of flattened tube. This could be accomplished with a set of rollers or by supplying a top coil with round tubes and the bottom coil with elliptical or flattened tubes. Yet another means to manufacture the different tube geometric shapes would be to stamp out the varying tube shapes and weld the plates together as found in U.S. Pat. No. 4,434,112. It is likely that heat exchangers will soon be designed and produced via 3D printer machines to the exact geometries to optimize heat transfer as proposed in this invention.

The tube run flattening could be accomplished in-line with the tube manufacturing process via the addition of automated rollers between the tube mill and bending process. Alternately, the flattening process could be accomplished as a separate step with a pressing operation after the bending has occurred. The embodiments presented are applicable to any common heat exchanger tube material with the most common being galvanized carbon steel, copper, aluminum, and stainless steel but the material is not a limitation of the invention.

Now that the tube circuits can be progressively flattened thereby reducing the horizontal cross sectional dimension, it is possible now to extremely densify the tube run circuits without choking external air flow. The proposed embodiments thusly allow for "extreme densifying" of indirect heat exchanger tube circuits. A method described in U.S. Pat. No. 6,820,685 can be employed to provide depression areas in the area of overlap of the U-bends to locally reduce the diameter at the return bend if desired. In addition, users skilled in the art will be able to manufacture return bends in tube runs at the desired flattening ratios and this is not a limitation of the invention.

Another way to manufacture a change in geometrics shape is to employ the use of a top and bottom indirect heat exchanger. The top heat exchanger may be made of all round tubes while the bottom heat exchanger can be made with a more streamlined shape. This conserves the heat transfer surface area while increasing overall air flow and decreasing the internal cross sectional area. Another way to manufacture a change in geometric shape is to employ the use of a top and bottom indirect heat exchanger. The top heat exchanger may be made of all round tubes while the bottom heat exchanger can be made with a reduction in circuits compared to the top coil. This reduces the heat transfer surface area while increasing overall air flow and decreasing the internal cross sectional area. As long as the top and bottom coils have at least one change in geometric shape or number of circuits, the indirect heat exchange system would be in accordance with this embodiment.

It is an object of the invention to start out with large internal cross sectional area tube runs then progressively reduce the horizontal cross sectional dimension of tube runs as they progress from the inlet to the outlet to reduce the drag coefficient and allow more external airflow.

It is an object of the invention to start out with large internal cross sectional area tube runs then progressively reduce the horizontal cross sectional dimension of the tube runs as they progress from the inlet to the outlet to allow the lowest density fluid (vapor) to enter the tube run with very little pressure drop to maximize internal fluid flow rate.

It is an object of the invention to start out with large internal cross sectional area tube runs then progressively reduce the horizontal cross sectional dimension of tube runs as they progress from the inlet to the outlet to allow for extreme tube circuit densification without choking external airflow.

It is an object of the invention to start out with large internal cross sectional area tube runs then progressively reduce the horizontal cross sectional dimension of tube runs as they progress from the inlet to the outlet to increase the internal fluid velocity and increase internal heat transfer coefficients in the direction of internal fluid flow path.

It is an object of the invention to start out with large internal cross sectional area tube runs then progressively reduce the horizontal cross sectional dimension of tube runs as they progress from the inlet to the outlet on condensers to take advantage of the fact that as the vapor condenses, there is less cross sectional area needed resulting in higher internal heat transfer coefficients with more airflow hence more capacity.

It is an object of the invention to start out with large internal cross sectional area tube runs then progressively reduce the horizontal cross sectional dimension of tube runs as they progress from the inlet to the outlet by balancing the customer demand on capacity desired and allowable internal fluid pressure drop to customize the indirect heat exchanger design to meet and exceed customer expectations.

It is an object of the invention to change a circuits tube run geometric shape at least once along the circuit path to allow simultaneously balancing of the external airflow, internal heat transfer coefficients, cross sectional area and heat transfer surface area to optimize heat transfer.

It is an object of the invention to change a plate coil's geometric shape at least once along the circuit path to allow simultaneously balancing of the external airflow, internal heat transfer coefficients, cross sectional area and heat transfer surface area to optimize heat transfer.

DETAILED DESCRIPTION

Figure 1:
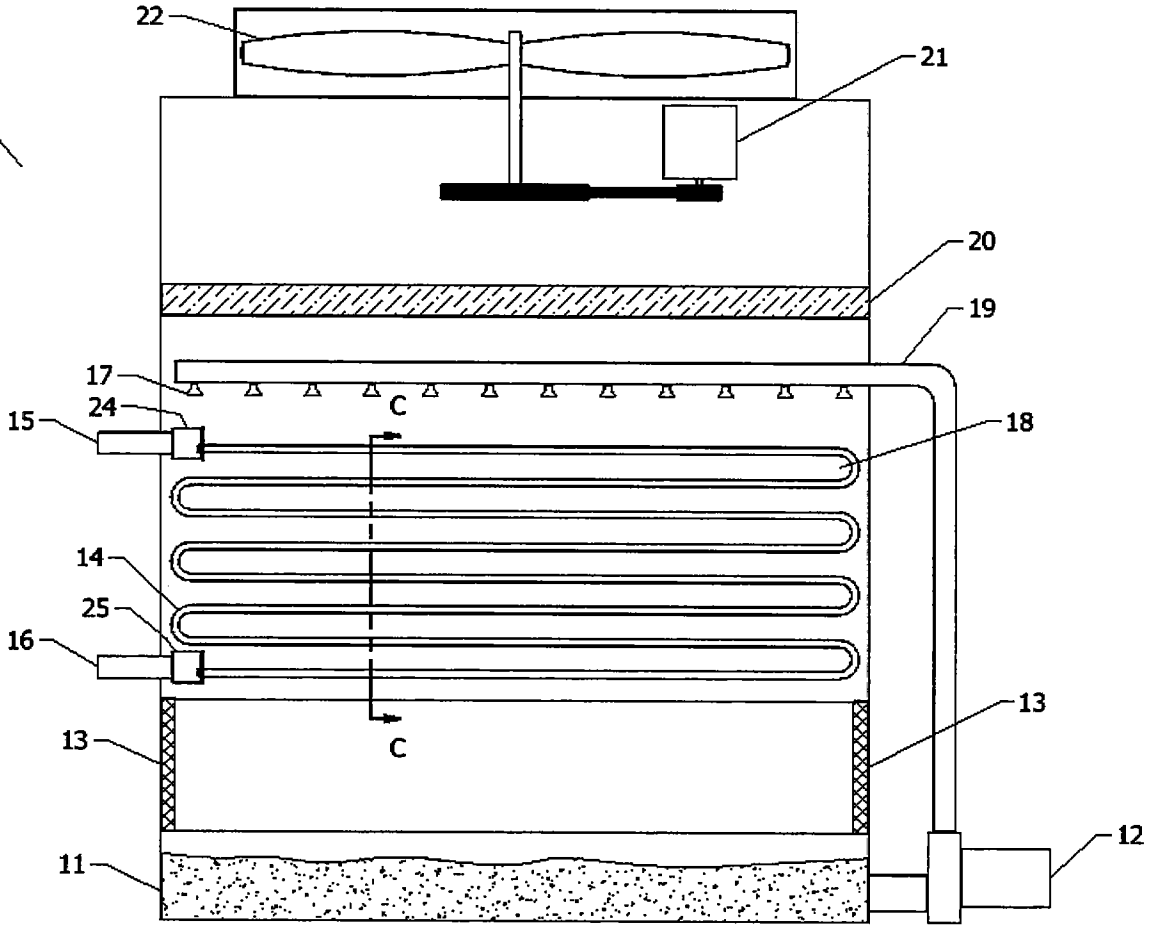
FIG. 1 is a side view of a prior art indirect heat exchanger including a series of serpentine tube runs.

Referring now to FIG. 1, a prior art evaporative cooled coil product 10 which could be a closed circuit cooling tower or an evaporative condenser. Both of these products are well known and can operate wet in the evaporative mode, partially wet in a hybrid mode or can operate dry, with the spray pump 12 turned off when ambient conditions or lower loads permit. Pump 12 receives the coldest cooled evaporatively sprayed fluid, usually water, from cold water sump 11 and pumps it to primary spray water header 19 where the water comes out of nozzles or orifices 17 to distribute water over indirect heat exchanger 14. Spray water header 19 and nozzles 17 serve to evenly distribute the water over the top of the indirect heat exchanger 14. As the coldest water is distributed over the top of indirect heat exchanger 14, motor 21 spins fan 22 which induces or pulls ambient air in through inlet louvers 13, up through indirect heat exchanger 14, then through drift eliminators 20 which serve to prevent drift from leaving the unit, and then the warmed air is blown to the environment. The air generally flows in a counterflow direction to the falling spray water. Although FIG. 1 is shown with axial fan 22 inducing or pulling air through the unit, the actual fan system may be any style fan system that moves air through the unit including but not limited to induced and forced draft in a generally counterflow, cross-flow or parallel flow with respect to the spray. Additionally, motor 21 may be belt drive as shown, gear drive or directly connected to the fan. Indirect heat exchanger 14 is shown with an inlet connection pipe 15 connected to inlet header 24 and outlet connection pipe 16 connected to outlet header 25. Inlet header 24 connects to the inlet of the multiple serpentine tube circuits while outlet header 25 connects to the outlet of the multiple serpentine tube circuits. Serpentine tube runs are connected with return bend sections 18. Return bend sections 18 may be continuously formed into the circuit called serpentine tube runs or may be welded between straight lengths of tubes. It should be understood that the process fluid direction may be reversed to optimize heat transfer and is not a limitation to embodiments presented. It also should be understood that the number of circuits and the number of passes or rows of tube runs within a serpentine indirect heat exchanger is not a limitation to embodiments presented.

Figure 2B:
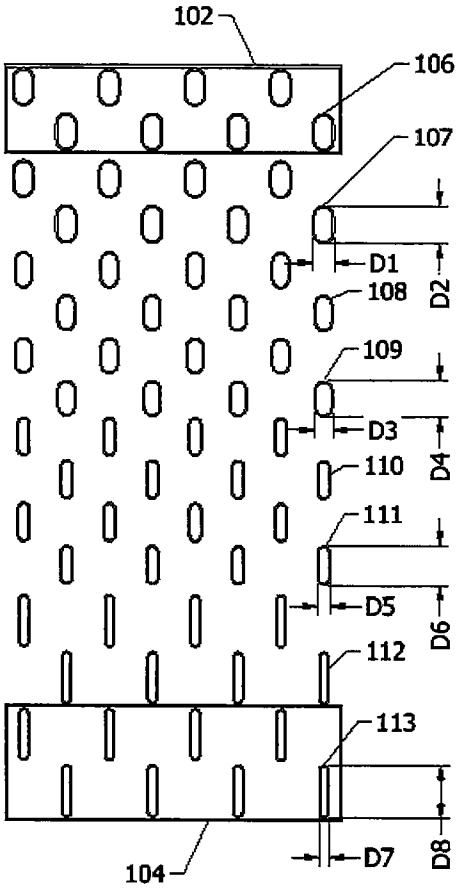
FIG. 2B is an end view of an indirect heat exchanger in accordance with a second embodiment of the present invention.
Figure 2A:
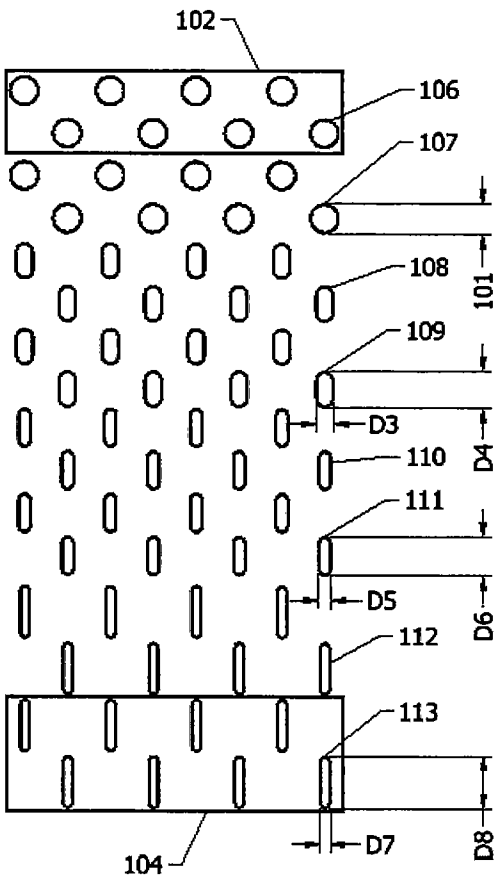
FIG. 2A is an end view of an indirect heat exchanger in accordance with the first embodiment of the present invention.

Referring now to FIG. 2A, indirect coil 100 is in accordance with a first embodiment of the present invention. FIG. 2A shows eight circuits and eight passes or tube rows of embodiment 100. Indirect heat exchanger 100 has inlet and outlet headers 102 and 104 and is comprised of tube runs 106, 107, 108, 109, 110, 111, 112, and 113. Tube runs 106 and 107 are a pair of identical geometry round tubes and have equivalent tube diameters 101. Tube runs 108 and 109 are another pair of tube runs having a different geometry compared to tubes run pairs 106 and 107 with equivalent shapes having reduced horizontal dimensions D3 and increased vertical dimension D4 with respect to round tubes 106 and 107. The ratio of D4 to D3 is usually greater than 1.0 and less than 6.0. Further, indirect heat exchanger tube run 108 and 109 may have a uniform ratio of D4 to D3 along its length as shown, or a uniformly increasing ratio of D4 to D3 along its length. The pair of tube runs 110 and 111 have yet a different geometry and have equivalent shapes with reduced horizontal dimensions D5 and increased vertical dimension D6 with respect to tube runs 108 and 109. The ratio of D6 to D5 is usually greater than 1.0, less than 6.0 and is also greater than ratio D4 to D3. Further, tube run 110 and 111 may have a uniform ratio of D6 to D5 along its length as shown, or a uniformly increasing ratio of D6 to D5 along its length. The pair of tube runs 112 and 113 have yet a different geometry and have equivalent shapes with reduced horizontal dimensions D7 and increased vertical dimension D8 with respect to tube runs 110 and 111. The ratio of D8 to D7 is usually greater than 1.0, less than 6.0 and also greater than ratio D6 to D5. Further, tube runs 112 and 113 may have a uniform ratio of D8 to D7 along its length as shown, or a uniformly increasing ratio of D8 to D7 along its length. Tube run 106 is connected to inlet header 102 of indirect heat exchanger 100 and tube run 113 is connected to outlet header 104. In a preferred embodiment arrangement, the tubes are round at the inlet having a 1.0 vertical to horizontal tube run dimension ratio and are progressively flattened up to a vertical to horizontal tube run dimension ratio near 3.0 near the outlet. The practical limits of horizontal to vertical dimension ratios are between 1.0 for round tubes and may be as high as 6. It should be understood in this first embodiment, that as the vertical to horizontal tube run dimension ratio increases, the tube runs become flatter and more streamlined which allows more airflow while keeping the internal and external surface area constant. It should be noted that in the first embodiment, the horizontal dimension is progressively reduced from the inlet to the outlet of the tube runs while the vertical dimension is progressively increased from the inlet to the outlet. It should be further understood that the tube shapes can start as round and be progressively flattened as shown, can start as flattened and be progressively more flattened or start out streamlined and become more streamlined. When dealing with elliptical shapes, the B/A ratio is usually greater than 1 and refers to the major and minor axis respectively. It should be further understood that the first tube run could be elliptical with a B/A ratio close to 1.0 and progressively increase the B/A elliptical ratio from the inlet to the outlet. It should be understood that the first embodiment shows progressively reduced horizontal dimensions and progressively increased vertical dimensions from the first to the last tube run and that the initial shape, whether round, elliptical or streamlined is not a limitation of the embodiment. It should further be understood that every two passes may have the same tube shape as shown or the entire tube may be progressively flattened or streamlined. The decision on how to make the indirect heat exchanger circuits is a balance between the amount of airflow improvement desired, difficulty in degree of manufacturing and allowable internal tube side pressure drop.

Referring now to FIG. 2B, indirect coil 150 is in accordance with a second embodiment of the present invention. FIG. 2B shows eight circuits and eight passes or tube rows of embodiment 150. Indirect heat exchanger 150 has inlet and outlet headers 102 and 104 and is comprised of tube runs 106, 107, 108, 109, 110, 111, 112, and 113. Tube runs 106 and 107 in FIG. 2B are not round as they were in FIG. 2A, instead they are a pair of tube runs having initial horizontal dimension D1 and initial vertical dimension D2. Tube runs 108 and 109 are another pair of tube runs having a different geometry compared to tubes run pairs 106 and 107 with equivalent shapes having reduced horizontal dimensions D3 and increased vertical dimension D4 with respect to round tubes 106 and 107. The ratio of D4 to D3 is usually greater than 1.0 and less than 6.0 and the ratio of D4 to D3 is usually larger than the ratio of D2 to D1. Further, indirect heat exchanger tube run 108 and 109 may have a uniform ratio of D4 to D3 along its length as shown, or a uniformly increasing ratio of D4 to D3 along its length. The pair of tube runs 110 and 111 have yet a different geometry and have equivalent shapes with reduced horizontal dimensions D5 and increased vertical dimension D6 with respect to tube runs 108 and 109. The ratio of D6 to D5 is usually greater than 1.0, less than 6.0 and is also greater than ratio D4 to D3. Further, tube run 110 and 111 may have a uniform ratio of D6 to D5 along its length as shown, or a uniformly increasing ratio of D6 to D5 along its length. The pair of tube runs 112 and 113 have yet a different geometry and have equivalent shapes with reduced horizontal dimensions D7 and increased vertical dimension D8 with respect to tube runs 110 and 111. The ratio of D8 to D7 is usually greater than 1.0, less than 6.0 and also greater than ratio D6 to D5. Further, tube runs 112 and 113 may have a uniform ratio of D8 to D7 along its length as shown, or a uniformly increasing ratio of D8 to D7 along its length. Tube run 106 is connected to inlet header 102 of indirect heat exchanger 100 and tube run 113 is connected to outlet header 104. In one arrangement, the tubes begin nearly round at the inlet having a vertical to horizontal tube run dimension ratio near 1.0 and are progressively flattened up to a vertical to horizontal tube run dimension ratio near 3.0 near the outlet. The practical limits of horizontal to vertical dimension ratios are between 1.0 for round tubes and may be as high as 6. It should be understood in this second embodiment, that as the vertical to horizontal tube run dimension ratio increases, the tube runs become flatter and more streamlined which allows more airflow while keeping the internal and external surface area constant. It should be noted that in this second embodiment, the horizontal dimension is progressively reduced from the inlet to the outlet of the tube runs while the vertical dimension is progressively increased from the inlet to the outlet. It should be further understood that the tube shapes can start slightly flattened, as compared to the first embodiment shown in FIG. 2A which started with round tubes, and then be progressively flattened as shown or start out streamlined and become more streamlined. When dealing with elliptical shapes, the B/A ratio is usually greater than 1 and refers to the major and minor axis respectively. It should be further understood that the first tube run could be elliptical with a B/A ratio close to 1.0 and progressively increase the B/A elliptical ratio from the inlet to the outlet. It should be understood that the second embodiment shows progressively reduced horizontal dimensions and progressively increased vertical dimensions from the first to the last tube run and that the initial shape, whether round, elliptical or streamlined is not a limitation of the embodiment. It should further be understood that every two passes may have the same tube shape as shown or the entire tube may be progressively flattened or streamlined. The decision on how to make the indirect heat exchanger circuits is a balance between the amount of airflow improvement desired, difficulty in degree of manufacturing and allowable internal tube side pressure drop.

Figure 3:
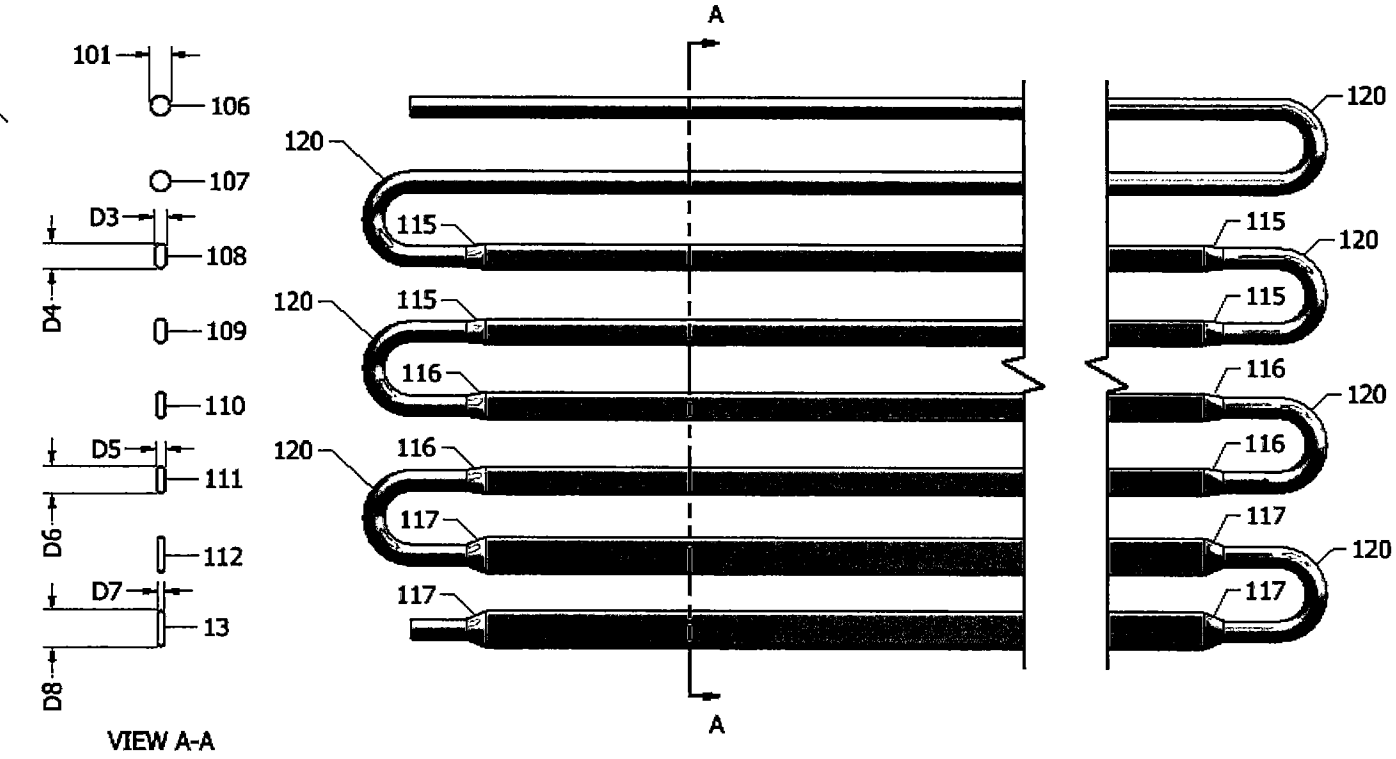
FIG. 3 is a side view of one circuit from the indirect heat exchanger in accordance with the first embodiment of the present invention.

Referring now to FIG. 3, circuit 103 from the first embodiment of FIG. 2 is shown from a side view for understanding how each circuit may be constructed. Tube runs 106, 107, 108, 109, 110, 111, 112 and 113 are also shown from sectional view AA. Tube runs 106 and 107 are generally round tubes and have equivalent tube diameters 101. Tube run 106 has round U-bend 120 connecting it to tube run 107. Tube run 107 is connected to tube run 108 with transition 115. Transition 115 starts as round on one end and transitions to the shape of D4 to D3 ratio at the other end. Transition 115 can be simply pressed or casted from a die, extruded, or can be a fitting which is typically welded or brazed into the tube runs. Transition 115 can also be pressed into the tube when the tube is going through the serpentine bending operation. The method of forming transition 115 is not a limitation of the invention. Round U-bends 120 can be formed to nest to the next return bend such that the number of circuits in the indirect heat exchanger may be densified as taught in U.S. Pat. No. 6,820,685. U-bends 120 may also be mechanically flattened while the tube runs are being bent and assume the general shape at each tube run pass which would be a changing return bends shape throughout the coil circuit. The previous discussion is the same for transitions 115,116 and 117. Tube runs 108 and 109 have equivalent and reduced horizontal dimensions D3 and increased vertical dimension D4. The ratio of D4 to D3 is usually greater than 1.0 and less than 6.0. Further, coil tube run 108 and 109 may have a uniform ratio of D4 to D3 along its length as shown, or a uniformly increasing ratio of D4 to D3 along its length. Tube runs 110 and 111 have equivalent and reduced horizontal dimensions D5 and increased vertical dimension D6. The ratio of D6 to D5 is usually greater than 1.0, less than 6.0 and also greater than ratio D4 to D3. Further, tube runs 110 and 111 may have a uniform ratio of D6 to D5 along its length as shown, or a uniformly increasing ratio of D6 to D5 along its length. Tube runs 112 and 113 have equivalent and reduced horizontal dimensions D7 and increased vertical dimension D8. The ratio of D8 to D9 is usually greater than 1.0, less than 6.0 and also greater than ratio D6 to D5. Further, tube run 112 and 113 may have a uniform ratio of D8 to D7 along its length as shown, or a uniformly increasing ratio of D8 to D7 along its length.

Figure 4B:
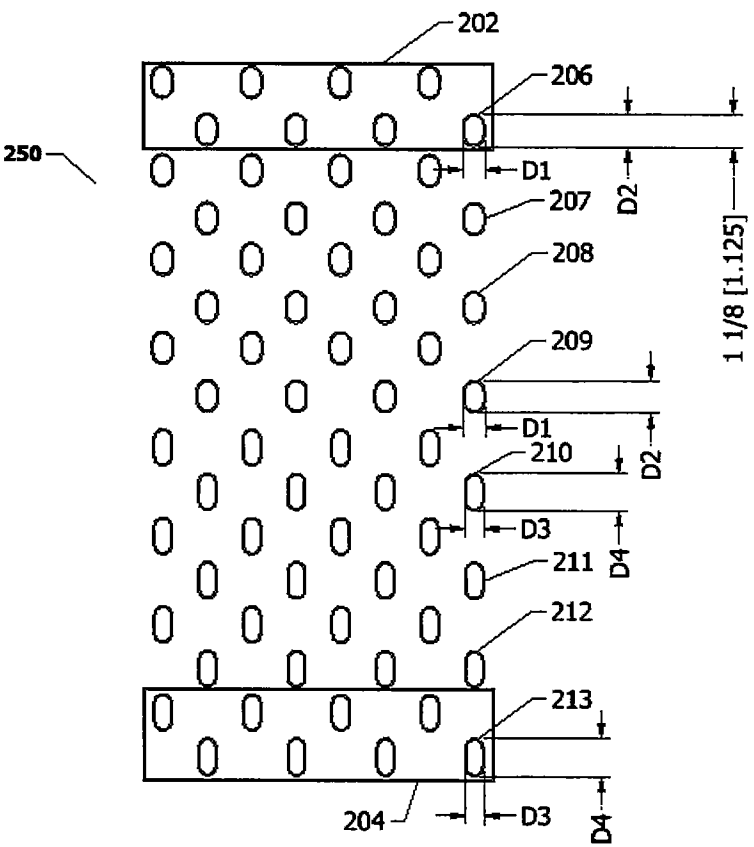
FIG. 4B is an end view of an indirect heat exchanger in accordance with a fourth embodiment of the present invention.
Figure 4A:
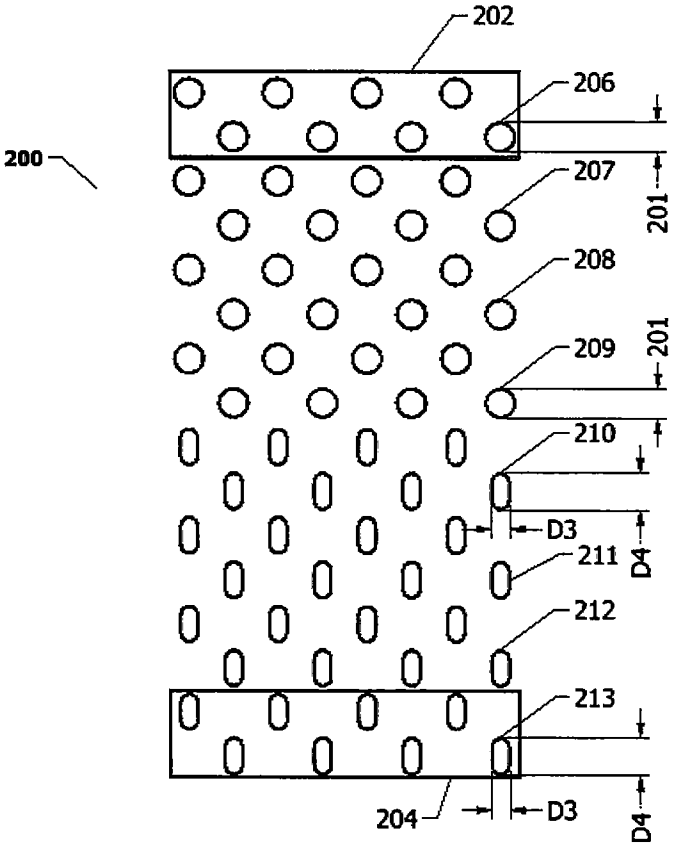
FIG. 4A is an end view of an indirect heat exchanger in accordance with a third embodiment of the present invention.

Referring now to FIG. 4A, indirect heat exchanger 200 is in accordance with a third embodiment of the present invention. Embodiment 200 has eight circuits and eight passes or tube runs. Embodiment 200 has at least one reduction in horizontal dimension and one increase in vertical dimension within the circuit tube runs. Indirect heat exchanger 200 has inlet and outlet headers 202 and 204 respectively and is comprised of coil tubes having run lengths 206, 207,208,209,210,211,212 and 213. It should be noted that tube runs 206,207,208 and 209 have equivalent tube diameters 201. Embodiment 200 also has tube runs 210,211,212, and 213 each having equivalent horizontal cross section dimensions D3 and equivalent vertical cross section dimensions D4. The ratio of D4 to D3 is usually greater than 1.0, less than 6.0 and the vertical dimension D4 is larger than tube diameter 201 while the horizontal dimension D3 is less than tube diameter 201. In one arrangement of the third embodiment, the first ratio is greater than or equal to 1.0 and less than 2.0 (it's equal to 1.0 with round tubes) and the second ratio is greater than the first ratio but less than 6.0. Of note is that in the third embodiment of FIG. 4A, each circuit tube run length has at least one change in geometric shape as the circuit tube run extends from the inlet to the outlet. The decision of how many tube runs have reduced horizontal cross section dimensions as shown with FIGS. 6 and 7 is a balance between the amount of airflow improvement desired, difficulty in degree of manufacturing and allowable internal tube side pressure drop and is not a limitation of the invention.

Referring now to FIG. 4B, indirect heat exchanger 250 is in accordance with a fourth embodiment of the present invention. Embodiment 250 has eight circuits and eight passes or tube runs. Embodiment 250 has at least one reduction in horizontal dimension and increase in vertical dimension within the circuit tube runs. Indirect heat exchanger 250 has inlet and outlet headers 202 and 204 respectively and is comprised of coil tubes having run lengths 206, 207, 208,209,210,211,212 and 213. It should be noted that unlike the embodiment shown in FIG. 4A, which started with round tubes in the first passes or rows, embodiment 250 has tube runs 206,207,208 and 209 each having equivalent horizontal cross section dimensions D1 and equivalent vertical cross section dimensions D2. The ratio of D2 to D1 is usually greater than 1.0 and less than 6.0. Embodiment 250 also has tube runs 210, 211, 212, and 213 each having equivalent horizontal cross section dimensions D3 and equivalent vertical cross section dimensions D4. The ratio of D4 to D3 is usually greater than 1.0, less than 6.0 and usually larger than the ratio of D2 to D1. In one arrangement of the fourth embodiment, the first ratio (D2/D1) is greater than or equal to 1.0 and less than 2.0 (D2/D1 is greater than 1.0 as shown) and the second ratio (D4/D3) is greater than the first ratio but less than 6.0. Of note is that in the fourth embodiment of FIG. 4B, each circuit tube run length has at least one change in geometric shape as the circuit tube run extends from the inlet to the outlet. The decision of how many tube runs have reduced horizontal cross section dimensions is a balance between the amount of airflow improvement desired, difficulty in degree of manufacturing and allowable internal tube side pressure drop and is not a limitation of the invention.

Figure 5:
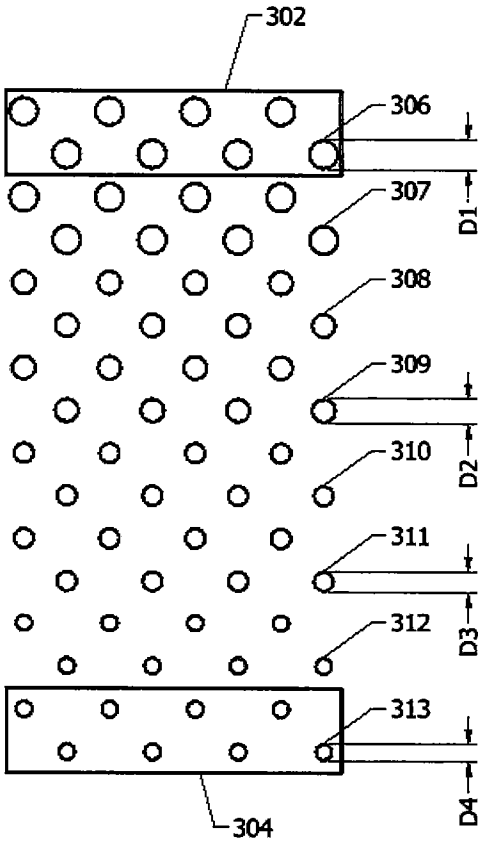
FIG. 5 is an end view of an indirect heat exchanger in accordance with a fifth embodiment of the present invention.

Referring now to FIG. 5, indirect heat exchanger 300 is in accordance with a fifth embodiment of the present invention. Embodiment 300 has eight circuits and eight passes or tube runs where each pair of tube runs have a different diameter and has progressively smaller diameters from the inlet tube run 306 to the outlet tube run 313. Embodiment 300 has inlet and outlet headers 302 and 304 respectively and is comprised of coil tubes having tube runs 306,307, 308,309,310, 311,312 and 313. It should be noted that the pair of tube runs 306 and 307 have diameter D1, tube runs 308 and 309 have tube diameter D2, tube runs 310 and 311 have tube diameter D3, and tube runs 312 and 313 have tube diameter D4. It should be noted that there are progressively smaller tube run diameters proceeding from the inlet tube run 306 to the outlet tube run 313 and that D1>D2>D3>D4. It is possible to have every tube run be a different diameter or there can only be one change in tube run diameter within the tube circuit runs and these both would still be in accordance with the fifth embodiment. The tubes are shown in the fifth embodiment as round but each tube could be flattened or streamlined as well to provide even more airflow and the actual geometry is not a limitation of the invention. The decision on how many tube runs have a different diameter is a balance between the amount of airflow improvement desired, difficulty in degree of manufacturing and allowable internal tube side pressure drop. Tubes runs of differing diameters may be joined together by being welded or brazed, joined by a reducing coupling, joined by sliding the smaller diameter tube inside the larger diameter tube and then brazing or could be mechanically fastened. The means of connecting tubes runs of differing diameters is not a limitation of the invention. The fifth embodiment has a reduction in cross sectional area, a reduction in tube surface area with an increase in external airflow.

Figure 6:
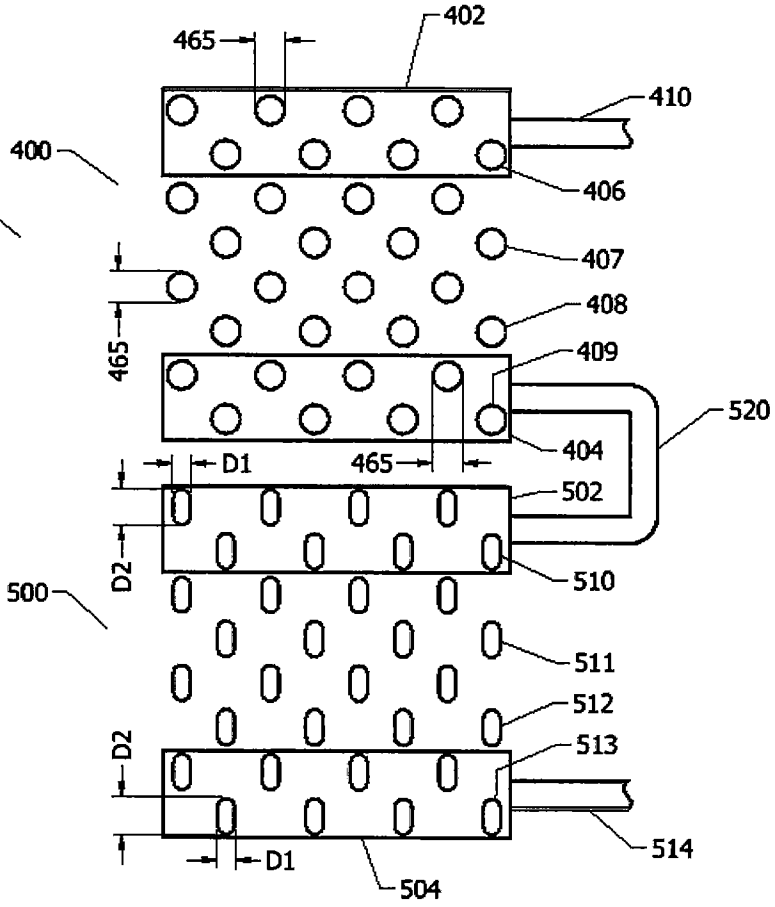
FIG. 6 is an end view of two indirect heat exchangers in accordance with a sixth embodiment of the present invention.

Referring now to FIG. 6, sixth embodiment 450 is shown with at least two indirect heat exchangers 400 and 500. Embodiment 450 has top indirect heat exchanger 400 with eight circuits and four passes or tube runs and bottom indirect heat exchanger 500 also has eight circuits and four passes or tube runs. Top indirect heat exchanger 400 is positioned on top of bottom indirect heat exchanger 500 such that there are a total of eight circuits and eight passes or tube runs for the entire indirect heat exchanger of embodiment 450. Top indirect coil 400 has inlet and outlet headers 402 and 404 and is comprised of a tube runs 406,407,408 and 409 having generally round tube runs of the same diameter 465. It should be understood that tube runs 406, 407,408 and 409 are four passes and comprise one of the eight circuits of indirect coil 400 and that the coil tubes are connected by Ubends that are not shown. Bottom indirect heat exchanger 500 has inlet and outlet headers 502 and 504 and is comprised of tube runs 510,511,512 and 513. Tube runs in the bottom indirect heat exchanger 500 all have the same D2 to D1 ratio which is usually larger than 1.0, less than 6.0 and vertical dimension D2 is greater than top indirect tube run diameter 465. It should be understood that tube runs 510, 511, 512 and 513 are four passes and comprise one of the eight circuits of indirect heat exchanger 500 and that the tube runs are connected by Ubends that are not shown. It should be further understood that all tubes shown in bottom indirect heat exchanger 500 have generally the same flattened tube shape and same D2 to D1 ratio. Top indirect heat exchanger outlet header 404 is connected to bottom indirect heat exchanger 500 inlet header 502 via connection piping 520 as shown. Alternatively, inlet headers 402 and 502 may be connected in together in parallel and outlet headers 404 and 504 may be connected in parallel (not shown). Note that bottom indirect heat exchanger 500 may instead employ smaller diameter tubes or simply a more streamlined tube shape than the top indirect heat exchanger 400 tube runs and still be in accordance with the sixth embodiment. Top indirect heat exchanger 400 is shown with round tubes but as shown in FIG. 4B, the tubes in top indirect section 400 may start with a less flattened shape than the bottom indirect heat exchange section 500 and still be in accordance with the sixth embodiment. Top and bottom indirect heat exchanger tube runs may all also be elliptical with the top indirect heat exchanger tube runs B/A ratio being smaller than the bottom indirect heat exchanger tube run B/A ratio and still is in accordance with the sixth embodiment. The decision on the geometry difference between the top and bottom indirect heat exchangers is a balance between the amount of airflow improvement desired, difficulty in degree of manufacturing and allowable internal tube side pressure drop.

Figure 7C:
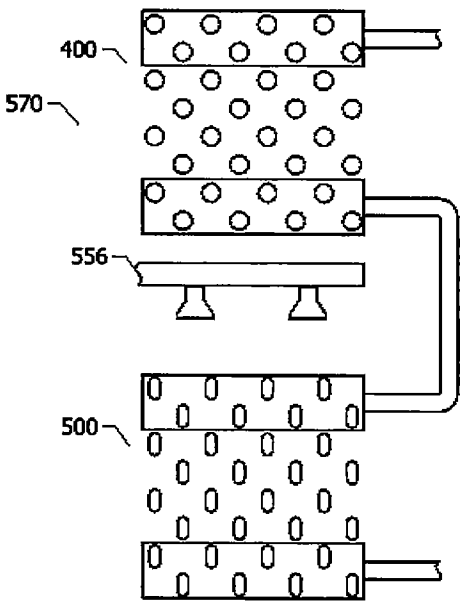
FIG. 7C is an end view of two indirect heat exchangers in accordance with a ninth embodiment of the present invention.
Figure 7B:
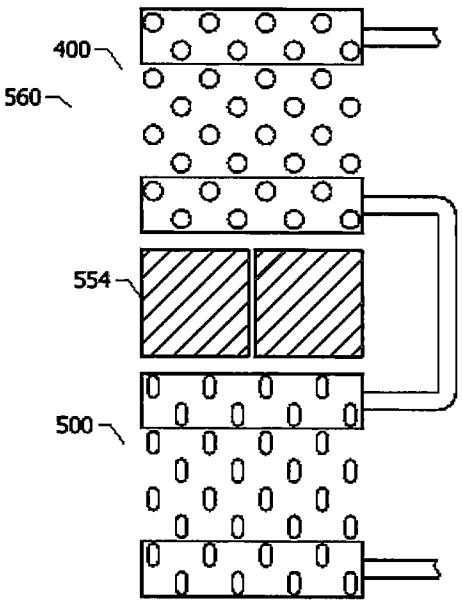
FIG. 7B is an end view of two indirect heat exchangers in accordance with an eighth embodiment of the present invention.
Figure 7A:
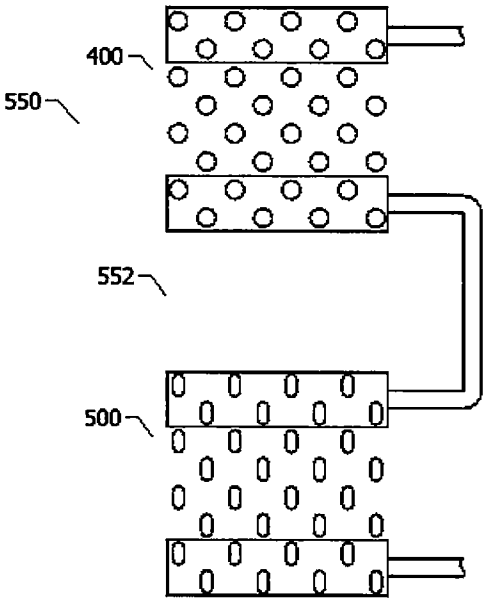
FIG. 7A is an end view of two indirect heat exchangers in accordance with a seventh embodiment of the present invention.

Now referring to FIGS. 7A, 7B and 7C the seventh, eighth and ninth embodiments are shown respectively. To further increase heat exchange efficiency of the sixth embodiment 450 shown in FIG. 6, seventh embodiment 550 is shown in FIG. 7 A with gap 552 separating top indirect heat exchanger 400 and bottom indirect heat exchanger 500. Gap 552, which is greater than one inch in height, allows more rain zone cooling of the spray water by allowing direct contact between the air flowing and the spray water generally flowing downward. Another way to further increase the heat exchange efficiency of the sixth embodiment 450 of FIG. 6 is to add direct heat exchange section 554 between top indirect heat exchange section 400 and bottom indirect heat exchange section 500 as shown in eighth embodiment 560 in FIG. 7B. Adding direct section 554, which is at least one inch in height, allows spray water cooling between indirect heat exchange sections 400 and 500 by allowing direct heat exchange between the air flowing and the spray water which is flowing generally downward. To achieve a hybrid mode of operation of sixth embodiment 450 shown in FIG. 6, secondary spray section 556 is added between top indirect heat exchange section 400 and bottom indirect heat exchange section 500 as shown in ninth embodiment 570 in FIG. 7C. Adding secondary spray section 556 allows bottom indirect heat exchanger 500 to operate wet when top heat exchange section 400 may run dry which saves water and adds a hybrid mode of operation.

Figure 8:
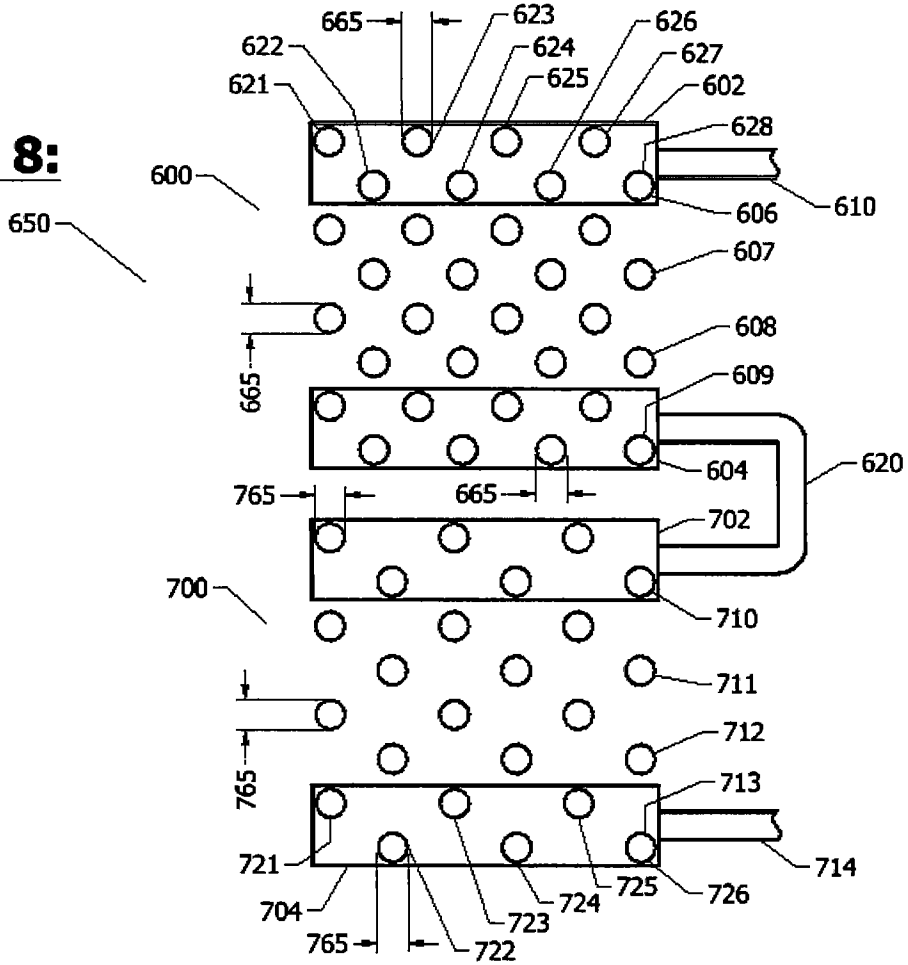
FIG. 8 is an end view of two indirect heat exchangers in accordance with a tenth embodiment of the present invention.

Referring now to FIG. 8, tenth embodiment 650 is shown with at least two indirect heat exchangers 600 and 700. Embodiment 650 has top indirect heat exchanger 600 with eight circuits and four passes or tube runs. Note however, that bottom indirect heat exchanger 700 has a reduction in the number of circuits compared to top indirect heat exchange section 600. In this case, bottom indirect section 700 has six circuits while top indirect section 600 has eight circuits. Top indirect heat exchanger 600 is positioned on top of bottom indirect heat exchanger 700 such that there are a total of eight tube runs but note that the reduction of horizontal tube projection is accomplished by changing the number of circuits hence changing the geometry of projected tubes in the airflow direction. This change in geometry between the top and bottom indirect sections 600 and 700 respectively decreases total tube cross section area, reduces total tube heat transfer surface area while increases external airflow. Top indirect heat exchange section 600 has inlet and outlet headers 602 and 604 and is comprised of a tube runs 606,607,608 and 609 having generally round tube runs of the same diameter 665. It should be understood that tube runs 606,607,608 and 609 are four passes and comprise one of the eight circuits of indirect heat exchange section 600 and that the tube runs are connected by return bends that are not shown. Bottom indirect heat exchange section 700 has inlet and outlet headers 702 and 704 and is comprised of tube runs 710, 711, 712 and 713 all having generally round tube runs of the same diameter 765 which is generally the same diameter as tube run diameters 665. It should be understood that tube runs 710, 711, 712 and 713 are four passes and comprise one of the six circuits of indirect heat exchanger 700 and that the tube runs are connected by return bends that are not shown. Top indirect heat exchanger outlet header 604 is connected to bottom indirect heat exchanger 700 inlet 702 via connection piping 620 as shown. Alternatively, inlet headers 602 and 702 may be connected in together in parallel and outlet headers 604 and 704 may be connected in parallel (not shown). Note that top and bottom indirect heat exchange sections 600 and 700 respectively may employ the same tube shape, whether round, elliptical, flattened, or streamlined. It is the reduction of circuits in bottom heat exchange section 700 which is the methodology to reduce the horizontal projected tube geometry to increase air flow, increase internal fluid velocity and internal heat transfer coefficients in the tenth embodiment 650. The decision on the geometries used, and the difference in the number of circuits between the top and bottom indirect heat exchanger sections is a balance between the amount of airflow improvement desired, difficulty in degree of manufacturing and allowable internal tube side pressure drop. As was shown in FIGS. 7A, 7B and 7C in how to further increase heat exchange efficiency of the sixth embodiment which included two indirect heat exchanger sections, the same can be done with the tenth embodiment where top indirect heat exchanger 600 and bottom indirect heat exchanger 700 can be separated by adding a gap greater than one inch as shown in FIG. 7A or by adding a direct heat exchange section as shown in FIG. 7B. To add a hybrid mode of operation to the tenth embodiment, a secondary spray section may be added between the two indirect heat exchangers 600 and 700 as shown in FIG. 7C.

Figure 9:
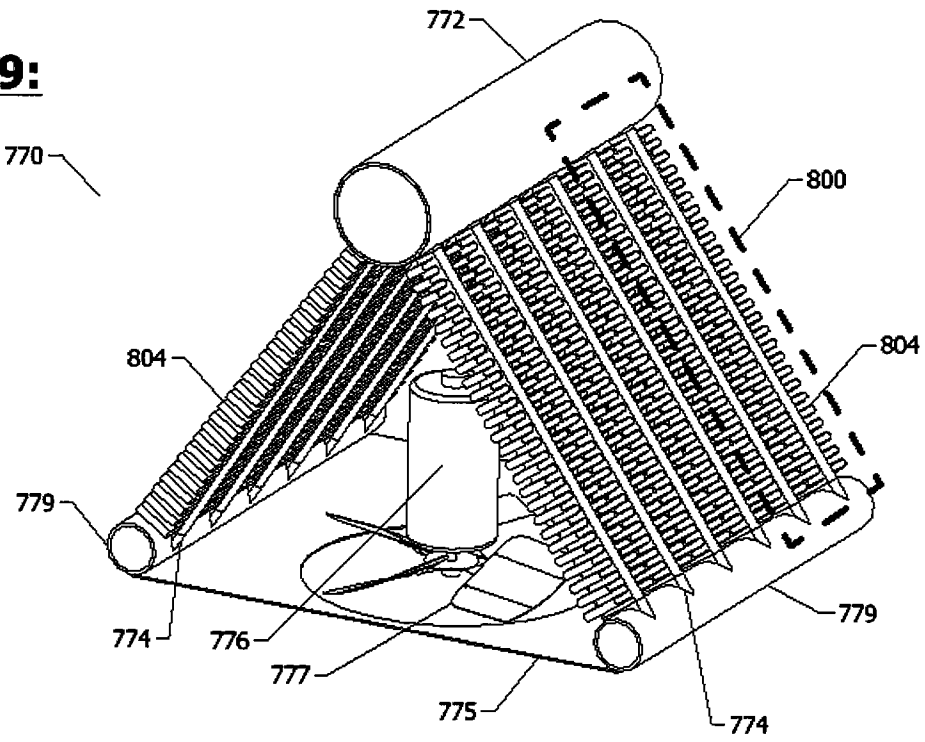
FIG. 9 is a 3-D view of an indirect heat exchanger in accordance with an eleventh embodiment of the present invention.

Now referring to FIG. 9, eleventh embodiment 770 is shown as an air cooled steam condenser. Steam header 772 feeds steam to tube runs 774. Tube runs 774 are fastened to steam header 772 and condensate collection headers 779 by various techniques including welding and oven brazing and is not a limitation of the invention. Wavy fins 804 are fastened to tube runs 774 by various techniques such as welding and oven brazing and is not a limitation of the invention. The purpose of wavy fins 804 is to allow heat to transfer from the tube to the fin to the flowing air stream. As the steam condenses in tube runs 774, water condensate is collected in condensate collection headers 779. Fan motor 776 spins fan 777 to force air through steam condenser wavy fins 804. Fan deck 775 seals off the pressurized air leaving fan 777 so it must exit through wavy fins 804. There are multiple parallel tube run circuits 774 and to show the details of the change in geometry of the tube runs 774 and wavy fins 804, two circuits shown within dotted lines 800 are shown in FIGS. 10A, 10B, and 10C for clarity.

Figure 10C:
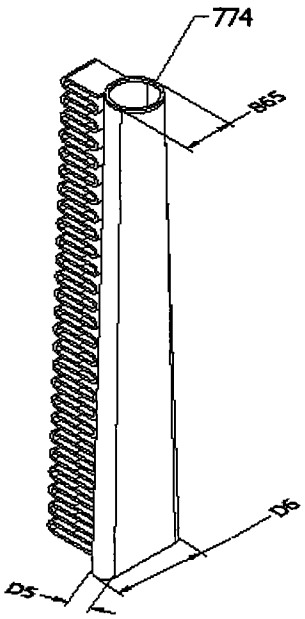
FIG. 10A, FIG. 10B and FIG. 10C are partial perspective views of the eleventh embodiment of the present invention.
Figure 10B:
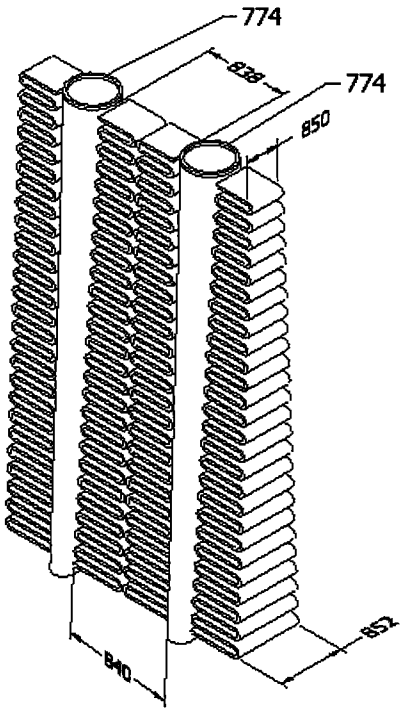
Figure 10A:
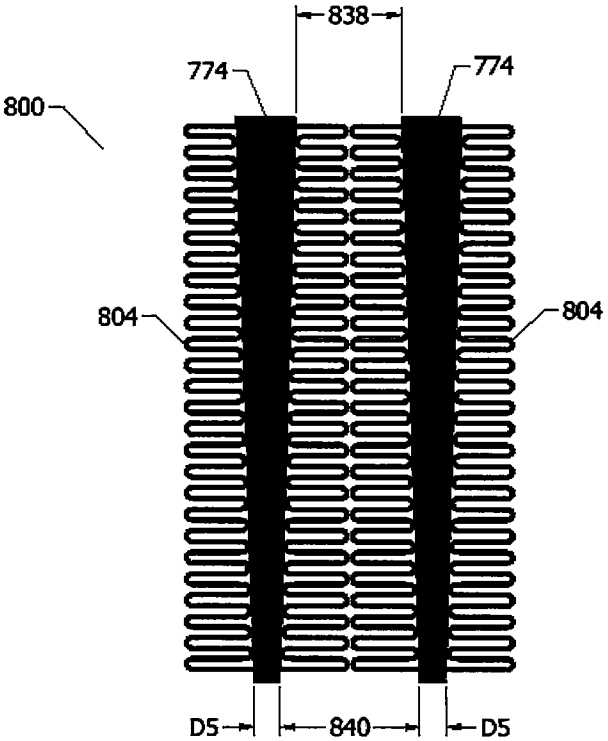

Now referring to FIGS. 10A, 10B & 10C, eleventh embodiment 770 from FIG. 9 is redrawn to show two tube runs in FIG. 10A which is a detailed view of tube runs 774 from FIG. 9. It should be noted that tube runs 774 have no return bends but instead are one long tube run. The length of the tube runs are typically a few feet up to a hundred feet and is not a limitation of the invention. The tube run circuits 774 are shown with just two of many (hundreds) of repeated parallel tube runs now with tube runs 774 and wavy fins 804. Wavy fins 804 are typically installed to each side of tube run 802 and function to increase the heat transfer from the air being forced through the wavy fins 804 to indirectly to condense the steam inside tube runs 774. Tube runs 774 have a round internal cross section at the top (having maximum internal cross sectional area at the steam connection) with diameter 865 shown in FIG. 10C. Tube run 774 is then progressively flattened from the top to the bottom such that the horizontal cross section dimension D5 is less then diameter 865 and the ratio of D6 to D5 is usually greater than 1 and less than 6. In the case of starting with a non-round shape, such as with micro channels for example, the ratio may be increase upwards to 20.0. The key to this embodiment is a change in geometric shape from the top to the bottom and can be any shape that is more streamlined near the bottom than the top and is not limited to a flattened shape. The distance between tube runs 774 can be seen at 838 at the top and wider dimension 840 at the bottom. The width of wavy fins 804 is 850 at the top and a wider dimension 852 at the bottom. This progressively widening of wavy fin 804 allows more contact area between the tube as one progresses from the top to bottom and more finned surface area as one travels from top to bottom which increases overall heat transfer to tube run 774. Referring to FIG. 10C where wavy fin 804 has been removed for clarity, it can be seen that tube run 774 is round with diameter 865 at the top and is flattened with width D5 and length D6. As was discussed with all the other embodiments, the progressive flattening can be done in steps having a uniform flattening dimension every few feet or the tube runs may have a uniformly increasing ratio of length to width (shown as D6 to D5 at the bottom) along its entire length as shown in FIG. 10C. There are multiple improvements of the eleventh embodiment of FIG. 10 over prior art. First, the internal cross sectional area is at a maximum at the top where the vapor to be condensed enters the tube. This allows the entering low density gas to flow at a higher flow rate with a lower pressure drop. Later as the vapor condenses, the need for internal cross sectional area is reduced because there is a much denser fluid having both vapor and condensate in the flow path and the geometry change allows optimum use of heat transfer surface area. In addition, the external and internal surface area is the same at the top and bottom of each tube run yet as the horizontal cross sectional dimension is progressively reduced, more air is invited to flow as the tube run is progressively flattened. In addition, the reduced horizontal cross sectional dimension with respect to the air flow path increases internal fluid velocities and internal heat transfer coefficients while allowing more external air to flow which increases the ability to condense more vapor. Another advantage is that as the tube run is flattened the wavy fin may be increased in size in both width and length if desired, and the fin to tube contact area increases as one proceeds from the tip to the bottom of the tube run which increases heat transfer to the tube.

Figure 11B:
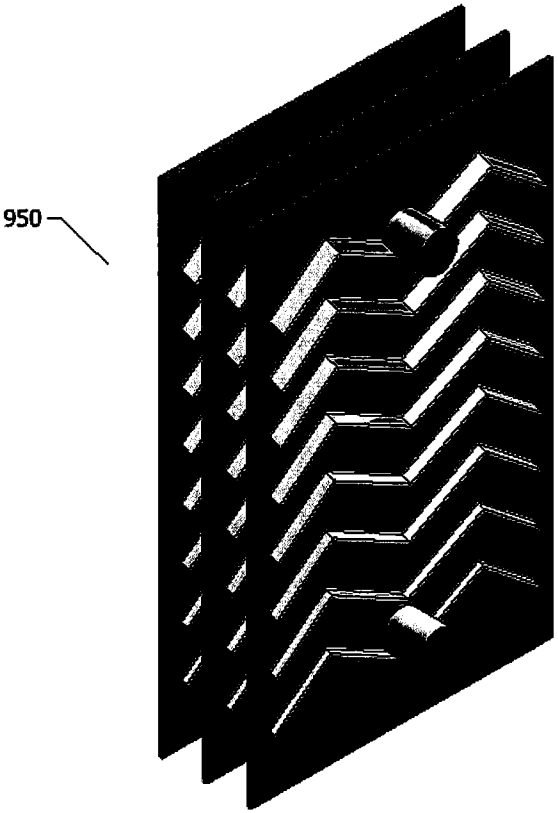
FIG. 11B is a 3-D view of the twelfth embodiment of the present invention.
Figure 11A:
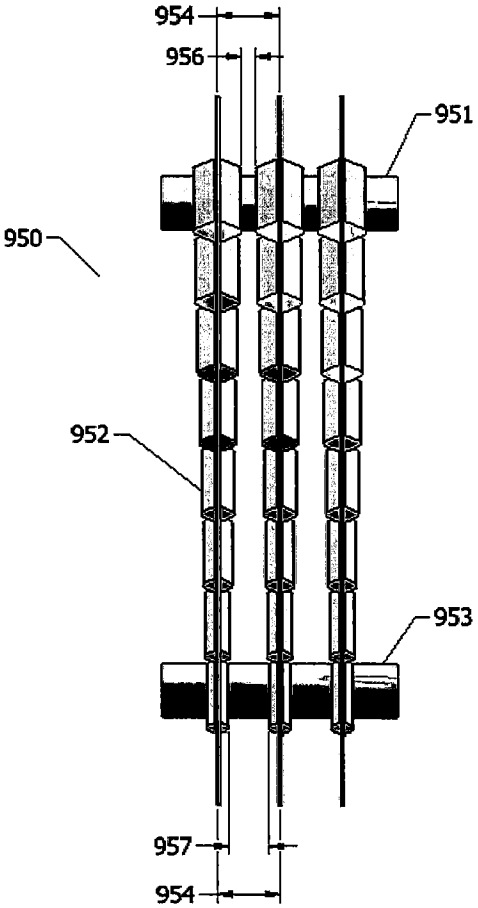
FIG. 11A is an end view of an indirect heat exchanger in accordance with a twelfth embodiment of the present invention.

Now referring to FIG. 11, an end view and 3D view of a twelfth embodiment of the present invention is shown as 950. Indirect heat exchange section 950 consists of indirect heat exchange plates 952 where, in a closed circuit cooling tower or evaporative condenser, evaporative water is sprayed on the external side of the plates and air is also passed on the external side of the plates to indirectly cool or condense the internal fluid. Inlet plate header 951 allows the fluid to enter the inside of the plates and exit heat 953 allows fluid inside the plates to exit back to the process. Of particular note is that centerline top spacing 954 and centerline bottom spacing 954 between the plates are uniform and generally equal while exterior plate air spacing gap 956 is purposely smaller than air spacing 957. Thus, the plates have a tapered shape in decreasing thickness from adjacent the inlet end to adjacent the outlet end. This change in plate geometry accomplishes many of the same benefits shown in all the other embodiments. In twelfth embodiment 950 there is essentially the same heat transfer surface area, a progressive reduction of internal cross sectional area from the inlet (top) to the outlet (bottom) and a progressively larger air gap 956 at the top compared to 957 at the bottom which allows more airflow, increases internal fluid velocity and increases internal heat transfer coefficients as one travels from the top to the bottom. The decision on the geometries used and the progressive air gaps between the top and bottom indirect plate heat exchanger sections is a balance between the amount of airflow improvement desired, difficulty in degree of manufacturing and allowable internal plate side pressure drop.

What is claimed is:

1. An indirect heat exchanger comprising:

a plurality of circuit tubes including a first circuit tube and a second circuit tube;

inlet and outlet headers connected to the circuit tubes;

an evaporative fluid supply configured to distribute evaporative fluid onto the circuit tubes;

a sump configured to collect evaporative fluid from the circuit tubes;

a pump configured to pump evaporative fluid from the sump to the evaporative fluid supply;

a fan and a motor operable to cause air to move over the circuit tubes;

each circuit tube extending in a series of run lengths and return bends, each circuit tube having vertical spacings between the run lengths of the circuit tube;

the run lengths of each circuit tube having a decreasing horizontal cross sectional dimension and an increasing vertical cross sectional dimension as the circuit tube extends from adjacent the inlet header to adjacent the outlet header;

inlet run lengths of the first and second circuit tube that are adjacent the inlet header, the inlet run lengths adjacent the inlet header having a first horizontal distance therebetween;

outlet run lengths of the first and second circuit tube that are adjacent the outlet header, the outlet run lengths adjacent the outlet header having a second horizontal distance therebetween;

wherein the first horizontal distance is smaller than the second horizontal distance;

wherein the first circuit tube and the second circuit tube are vertically offset from one another;

wherein the run lengths of the first circuit tube include a first plurality of intermediate run lengths intermediate the inlet and outlet run lengths of the first circuit tube along the first circuit tube;

wherein the run lengths of the second circuit tube include a second plurality of intermediate run lengths intermediate the inlet and outlet run lengths of the second circuit tube along the second circuit tube;

wherein the vertical spacings of the first circuit tube include first intermediate vertical spacings between the first plurality of intermediate run lengths and the vertical spacings of the second circuit tube include second intermediate vertical spacings between the second plurality of intermediate run lengths;

wherein the first plurality of intermediate run lengths of the first circuit tube are horizontally aligned with the second intermediate vertical spacings of the second circuit tube and the second plurality of intermediate run lengths of the second circuit tube are horizontally aligned with the first intermediate vertical spacings of the first circuit tube;

wherein the first plurality of intermediate run lengths have decreasing vertical distances from adjacent ones of the second plurality of intermediate run lengths as the first circuit tube extends from adjacent the inlet header to adjacent the outlet header; and wherein the second plurality of intermediate run lengths have decreasing vertical distances from adjacent ones of the first plurality of intermediate run lengths as the second circuit tube extends from adjacent the inlet header to adjacent the outlet header.

2. The indirect heat exchanger of claim 1 wherein the vertical spacings of each circuit tube between the run lengths of the circuit tube progressively narrow as the circuit tube extends from adjacent the inlet header to adjacent the outlet header.

3. The indirect heat exchanger of claim 1 wherein each circuit tube run length is of a uniform horizontal cross sectional dimension and a uniform vertical cross sectional dimension for the entire length of the circuit tube run length.

4. The indirect heat exchanger of claim 1 wherein the circuit tubes each have an inner surface that defines a fluid flow path and an outer surface opposite the inner surface, the inner surface and the outer surface having matching cross-sectional shapes throughout the circuit tube.

5. The indirect heat exchanger of claim 1 wherein the run lengths of each circuit tube have the same internal surface area and the same external surface area.

6. The indirect heat exchanger of claim 1 wherein the inlet run lengths of the first and second circuit tubes that are adjacent the inlet header each have a first ratio of the vertical cross sectional dimension of the run length to the horizontal cross sectional dimension of the run length;

wherein the outlet run lengths of the first and second circuit tubes that are adjacent the outlet header each have a second ratio of the vertical cross sectional dimension of the run length to the horizontal cross sectional dimension of the run length; and wherein the second ratio is larger than the first ratio.

7. The indirect heat exchanger of claim 6 wherein the first ratio is in the range of one to two, and the second ratio is greater than the first ratio but less than six.

8. The indirect heat exchanger of claim 1 wherein the run lengths of each circuit tube include run lengths having a non-circular cross section; and wherein the run lengths of each circuit tube have a uniform circumference.

9. The indirect heat exchanger of claim 1 wherein the inlet run lengths of the first and second circuit tube that are adjacent the inlet header each include a cylindrical outer surface extending from adjacent the inlet header to adjacent one of the return bends of the circuit tube.

10. The indirect heat exchanger of claim 1 wherein each circuit tube return bend is circular in cross section.

11. The indirect heat exchanger of claim 1 wherein each circuit tube includes galvanized steel, stainless steel, aluminum, and/or copper.

12. The indirect heat exchanger of claim 1 wherein each circuit tube has a unitary, one-piece construction.

13. The indirect heat exchanger of claim 1 wherein the run lengths each run lengths of the first and second circuit tubes include cylindrical run lengths having a circular cross-section, the cylindrical run lengths intermediate the inlet run lengths and the inlet header along the first and second circuit tubes.

14. An indirect heat exchanger comprising:

a plurality of circuit tubes including a first circuit tube and a second circuit tube;

inlet and outlet headers connected to the circuit tubes;

an evaporative fluid supply configured to distribute evaporative fluid onto the circuit tubes;

a sump configured to collect evaporative fluid from the circuit tubes;

a pump configured to pump evaporative fluid from the sump to the evaporative fluid supply;

a fan and a motor operable to generate airflow relative to the circuit tubes;

each circuit tube extending in a series of run lengths and return bends, each circuit tube having vertical spacings between the run lengths of the circuit tube;

inlet run lengths of the first and second circuit tube that are adjacent the inlet header;

outlet run lengths of the first and second circuit tube that are adjacent the outlet header;

wherein the first circuit tube and the second circuit tube are vertically offset from one another;

wherein the run lengths of the first circuit tube include a first plurality of intermediate run lengths intermediate the inlet and outlet run lengths of the first circuit tube along the first circuit tube;

wherein the first plurality of intermediate run lengths have a decreasing horizontal cross sectional dimension and an increasing vertical cross sectional dimension as the first circuit tube extends from the inlet run length toward the outlet run length thereof;

wherein the run lengths of the second circuit tube include a second plurality of intermediate run lengths intermediate the inlet and outlet run lengths of the second circuit tube along the second circuit tube;

wherein the second plurality of intermediate run lengths have a decreasing horizontal cross sectional dimension and an increasing vertical cross sectional dimension as the second circuit tube extends from the inlet run length toward the outlet run length thereof;

wherein the vertical spacings of the first circuit tube include first intermediate vertical spacings between the first plurality of intermediate run lengths and the vertical spacings of the second circuit tube include second intermediate vertical spacings between the second plurality of intermediate run lengths;

wherein the first plurality of intermediate run lengths of the first circuit tube are horizontally aligned with the second intermediate vertical spacings of the second circuit tube and the second plurality of intermediate run lengths of the second circuit tube are horizontally aligned with the first intermediate vertical spacings of the first circuit tube;

wherein the first plurality of intermediate run lengths have decreasing vertical distances from adjacent ones of the second plurality of intermediate run lengths as the first circuit tube extends from the inlet run length toward the outlet run length of the first circuit tube; and wherein the second plurality of intermediate run lengths have decreasing vertical distances from adjacent ones of the first plurality of intermediate run lengths as the second circuit tube extends from the inlet run length toward the outlet run length of the second circuit tube.

15. The indirect heat exchanger of claim 14 wherein the intermediate run lengths of the first circuit tube include:

a first intermediate run length adjacent the inlet run length of the first circuit tube, the first intermediate run length having a first horizontal cross-sectional dimension, a first vertical cross-sectional dimension, and a first circumference; and a second intermediate run length adjacent the outlet run length of the first circuit tube, the second intermediate run length having a second horizontal cross-sectional dimension less than the first horizontal cross-sectional dimension, a second vertical cross-sectional dimension larger than the first vertical cross-sectional dimension, and a second circumference the same as the first circumference.

16. The indirect heat exchanger of claim 14 wherein each run length of the first and second intermediate run lengths has the same or smaller horizontal cross sectional dimension and the same or larger vertical cross sectional dimension than the preceding run length as the circuit tube extends from adjacent the inlet run length toward the outlet run length.

17. The indirect heat exchanger of claim 14 wherein the intermediate run lengths of the first circuit tube have the same circumference.

18. The indirect heat exchanger of claim 14 wherein each circuit tube has a unitary, one-piece construction.

19. An indirect heat exchanger comprising:

a plurality of circuit tubes including a first circuit tube and a second circuit tube;

inlet and outlet headers connected to the circuit tubes;

an evaporative fluid supply configured to distribute evaporative fluid onto the circuit tubes;

a sump configured to collect evaporative fluid from the circuit tubes;

a pump configured to pump evaporative fluid from the sump to the evaporative fluid supply;

a fan and a motor operable to generate airflow relative to the circuit tubes;

each circuit tube extending in a series of run lengths and return bends, each circuit tube having vertical spacings between the run lengths of the circuit tube;

inlet run lengths of the first and second circuit tube that are adjacent the inlet header;

outlet run lengths of the first and second circuit tube that are adjacent the outlet header;

wherein the first circuit tube and the second circuit tube are vertically offset from one another;

wherein the run lengths of the first circuit tube include a first plurality of intermediate run lengths intermediate the inlet and outlet run lengths of the first circuit tube along the first circuit tube;

wherein the first plurality of intermediate run lengths have a decreasing horizontal cross sectional dimension and an increasing vertical cross sectional dimension as the first circuit tube extends from the inlet run length toward the outlet run length thereof;

wherein the run lengths of the second circuit tube include a second plurality of intermediate run lengths intermediate the inlet and outlet run lengths of the second circuit tube along the second circuit tube;

wherein the second plurality of intermediate run lengths have a decreasing horizontal cross sectional dimension and an increasing vertical cross sectional dimension as the second circuit tube extends from the inlet run length toward the outlet run length thereof;

wherein the vertical spacings of the first circuit tube include at least one first intermediate vertical spacing between the first plurality of intermediate run lengths and the vertical spacings of the second circuit tube include at least one second intermediate vertical spacing between the second plurality of intermediate run lengths;

wherein at least one of the first plurality of intermediate run lengths of the first circuit tube is horizontally aligned with the at least one second intermediate vertical spacing of the second circuit tube and at least one of the second plurality of intermediate run lengths of the second circuit tube is horizontally aligned with the at least one first intermediate vertical spacing of the first circuit tube;

wherein the first plurality of intermediate run lengths have decreasing vertical distances from adjacent ones of the second plurality of intermediate run lengths; and wherein the second plurality of intermediate run lengths have decreasing vertical distances from adjacent ones of the first plurality of intermediate run lengths.

20. The indirect heat exchanger of claim 19 wherein the intermediate run lengths of the first circuit tube include:

a first intermediate run length adjacent the inlet run length of the first circuit tube, the first intermediate run length having a first horizontal cross-sectional dimension, a first vertical cross-sectional dimension, and a first circumference; and a second intermediate run length adjacent the outlet run length of the first circuit tube, the second intermediate run length having a second horizontal cross-sectional dimension less than the first horizontal cross-sectional dimension, a second vertical cross-sectional dimension larger than the first vertical cross-sectional dimension, and a second circumference the same as the first circumference.

21. The indirect heat exchanger of claim 19 wherein each run length of the first and second intermediate run lengths has the same or smaller horizontal cross sectional dimension and the same or larger vertical cross sectional dimension than the preceding run length as the circuit tube extends from adjacent the inlet run length toward the outlet run length.

22. The indirect heat exchanger of claim 19 wherein the intermediate run lengths of the first circuit tube have the same circumference.

23. The indirect heat exchanger of claim 19 wherein each circuit tube has a unitary, one-piece construction.

24. The indirect heat exchanger of claim 19 wherein the at least one of the first plurality of intermediate run lengths of the first circuit tube comprises all of the first plurality of intermediate run lengths;

wherein the at least one of the second plurality of intermediate run lengths of the second circuit tube comprises all of the second plurality of intermediate run lengths; and wherein the first plurality of intermediate run lengths of the first circuit tube are horizontally aligned with the second intermediate vertical spacings of the second circuit tube and the second plurality of intermediate run lengths of the second circuit tube are horizontally aligned with the first intermediate vertical spacings of the first circuit tube.

25. The indirect heat exchanger of claim 19 wherein each of the first plurality of intermediate run lengths have a predetermined horizontal cross sectional dimension and a predetermined vertical cross sectional dimension throughout; and wherein each of the second plurality of intermediate run lengths have a predetermined horizontal dimension and a predetermined vertical dimension throughout.

26. An indirect heat exchanger comprising:

a plurality of circuit tubes including a first circuit tube and a second circuit tube;

inlet and outlet headers connected to the circuit tubes;

an evaporative fluid supply configured to distribute evaporative fluid onto the circuit tubes;

a sump configured to collect evaporative fluid from the circuit tubes;

a pump configured to pump evaporative fluid from the sump to the evaporative fluid supply;

a fan and a motor operable to generate airflow relative to the circuit tubes;

each circuit tube extending in a series of run lengths and return bends, each circuit tube having vertical spacings between the run lengths of the circuit tube;

inlet run lengths of the first and second circuit tubes that are adjacent the inlet header;

outlet run lengths of the first and second circuit tube that are adjacent the outlet header;

wherein the first circuit tube and the second circuit tube are vertically offset from one another;

wherein the run lengths of the first circuit tube include a first plurality of intermediate run lengths comprising:

a first run length having a first section with a first horizontal dimension and a first vertical dimension;

a second run length having a second section with a second horizontal dimension less than the first horizontal dimension and a second vertical dimension greater than the first vertical dimension, the second run length being farther from the inlet run length along the first circuit tube than the first run length;

a third run length having a third section with a third horizontal dimension less than the second horizontal dimension and a third vertical dimension greater than the second vertical dimension, the third run length farther from the inlet run length along the first circuit tube than the first and second run lengths;

wherein the run lengths of the second circuit tube includes a second plurality of intermediate run lengths comprising:

a fourth run length having a fourth section with a fourth horizontal dimension and a fourth vertical dimension;

a fifth run length having a fifth section with a fifth horizontal dimension less than the fourth horizontal dimension and a fifth vertical dimension greater than the fourth vertical dimension, the fifth run length being farther from the inlet run length along the second circuit tube than the fourth run length;

a sixth run length having a sixth section with a sixth horizontal dimension less than the fifth horizontal dimension and a sixth vertical dimension greater than the fifth vertical dimension, the sixth run length being farther from the inlet run length along the second circuit tube than the fourth and fifth run lengths;

wherein the vertical spacings of the first circuit tube include first intermediate vertical spacings between the first, second, and third sections and the vertical spacings of the second circuit tube include second intermediate vertical spacings between the fourth, fifth, and sixth sections;

wherein the first, second, and third sections of the first plurality of intermediate run lengths of the first circuit tube are horizontally aligned with the second intermediate vertical spacings of the second circuit tube and the fourth, fifth, and sixth sections of the second plurality of intermediate run lengths of the second circuit tube are horizontally aligned with the first intermediate vertical spacings of the first circuit tube;

wherein the first, second, and third sections have decreasing vertical distances from the fourth, fifth, and sixth sections as the first circuit tube extends from the first run length to the third run length; and wherein the fourth, fifth, and sixth sections have decreasing vertical distances from the first, second, and third sections as the second circuit tube extends from the fourth run length to the sixth run length.

27. The indirect heat exchanger of claim 26 wherein the second, third, fifth, and sixth sections have elliptical or obround cross-sections.

28. The indirect heat exchanger of claim 26 wherein the return bends of the first circuit tube include a first return bend connecting the second and third run lengths;

wherein the first return bend has an outer diameter that is greater than the third horizontal dimension and less than the third vertical dimension of the third section of the third run length of the first circuit tube.

29. The indirect heat exchanger of claim 26 wherein the inlet run length of the first circuit tube has a circular cross section and at least one of the first, second, and third sections have an elliptical or obround cross section.

30. The indirect heat exchanger of claim 26 wherein the return bends of the first circuit tube includes a first plurality of return bends on one side of the first circuit tube and a second plurality of return bends on an opposite side of the first circuit tube; and wherein the first plurality of bends have a uniform vertical spacing between the return bends and the second plurality of bends have a uniform vertical spacing between the return bends.

31. The indirect heat exchanger of claim 26 wherein the second section includes a first pair of arcuate wall portions having a first distance therebetween across an interior of the first circuit tube; and wherein the third section includes a second pair of arcuate wall portions having a second distance therebetween across the interior of the first circuit tube that is different than the first distance.

32. The indirect heat exchanger of claim 26 wherein the inlet run length has a cylindrical outer surface.

33. The indirect heat exchanger of claim 26 wherein the second run length has a first end section with a circular cross-section and a second end section with a circular cross-section; and wherein the second section of the second run length is intermediate the first end section and the second end section along the second run length.

34. The indirect heat exchanger of claim 26 wherein the third run length has end sections with the third section intermediate the end sections along the third run length; and wherein the end sections have vertical dimensions less than the third vertical dimension of the third section.

35. The indirect heat exchanger of claim 34 wherein the end sections have horizontal dimensions greater than the third horizontal dimension of the third section.

36. The indirect heat exchanger of claim 26 wherein the first and second circuit tubes are made of a metallic material.

37. The indirect heat exchanger of claim 26 wherein the sump is configured to receive evaporative liquid as the evaporative liquid falls from the circuit tubes.

* * * * *